United States Patent [19]

Makino

[11] Patent Number: 4,563,030

[45] Date of Patent: Jan. 7, 1986

[54] ORIENTATION-CONTROLLING APPARATUS FOR A SUSPENDER OF A CRANE

[75] Inventor: Kazuhiro Makino, Kudamatu, Japan

[73] Assignee: Hitachi, Ltd., Tokyo, Japan

[21] Appl. No.: 547,584

[22] Filed: Nov. 1, 1983

[30] Foreign Application Priority Data

Nov. 1, 1982 [JP] Japan ..... 57-190858

[51] Int. Cl.[4] ..... B66C 13/06

[52] U.S. Cl. ..... 294/81.4; 212/146; 212/147

[58] Field of Search ..... 212/146–148; 294/81.4

[56] References Cited

U.S. PATENT DOCUMENTS

| | | | |
|---|---|---|---|
| 3,868,139 | 2/1975 | Drelicharz | 294/81.4 |
| 4,168,857 | 9/1979 | Klous | 294/81.4 |
| 4,350,254 | 9/1982 | Noly | 294/81.4 |

FOREIGN PATENT DOCUMENTS

| | | | |
|---|---|---|---|
| 1186738 | 4/1970 | United Kingdom | 294/81.3 |
| 530842 | 12/1976 | U.S.S.R. | 212/147 |
| 141817 | 5/1980 | U.S.S.R. | 212/148 |

*Primary Examiner*—Trygve M. Blix
*Assistant Examiner*—R. Johnson
*Attorney, Agent, or Firm*—Antonelli, Terry & Wands

[57] ABSTRACT

An apparatus for controlling an orientation of a suspender hung from an overhead crane by four ropes, with the apparatus being adapted to control two orientations such as lateral and longitudinal inclinations of the suspender. A frame is adapted to be moved by a first screw mechanism, with second and third screw mechanisms being mounted on the frame. The second and third screw mechanisms have second and third threaded shafts which are movable relative to the frame in a direction parallel to a direction of movement of the frame and in opposite directions to each other. The four ropes for suspending the suspender are attached to appropriate ends of the second and third threaded shafts so that the apparatus can simultaneously control two orientations of the suspender. After a carrying out of an orientation control, the reactions applied to the apparatus can be borne by the self-locking action of the screw threads of the screw mechanisms.

11 Claims, 8 Drawing Figures

ORIENTATION-CONTROLLING APPARATUS FOR A SUSPENDER OF A CRANE

The present invention relates to a control apparatus and, more particularly, to a control apparatus for controlling an orientation of a suspender hung from an overhead crane by four cables or ropes.

The control of an orientation of a suspender of a crane can generally be divided into three basic types, namely, a transverse inclination of the suspender, hereinafter referred to as lateral inclination, a lengthwise inclination of the suspender, hereinafter referred to as a longitudinal inclination, and a slewing motion of the suspender, hereinafter referred to as slewing. Generally speaking, two of the abovenoted three orientation controls are selected in accordance with the particular application and necessary operations of the suspender. Thus, the orientation controls selected for a particular application or requirement may be, for example, lateral and longitudinal inclination control or longitudinal inclination and slewing control.

An orientation control apparatus of the aforementioned type is disclosed in, for example, Japanese Utility Model Publication No. 24786/1982, wherein the crane is adapted to suspend a long article, with the apparatus being adapted to control the slewing and longitudinal inclination thereof.

While the last-mentioned orientation controlling apparatus is capable of performing a simultaneous longitudinal inclination and slewing motion, it is necessary to provide a breaking arrangement and, consequently, the overall construction is relatively complicated.

In, for example, Japanese Patent Publication No. 81086/1982, another orientation control apparatus for a crane is proposed wherein the crane is adapted to handle or suspend a container.

The last mentioned type of orientation control apparatus requires a power transmission to be equipped with gears between two shafts of the apparatus; therefore, the overall size is considerably increased. Moreover, this proposed apparatus cannot effect simultaneous lateral and longitudinal inclination.

SUMMARY OF THE INVENTION

The aim underlying the present invention essentially resides in providing an orientation control apparatus for a suspender of an overhead crane, which suspender is hung by four cable means or ropes, with the apparatus being adapted to maintain an oriented state.

In accordance with advantageous features of the present invention, an orientation control apparatus for a suspender of an overhead crane includes a frame, with a first screw means being provided for moving the frame and second and third screw means being mounted on the frame, with the second and third screw means having second and third threaded shafts movable relative to the frame and parallel to the direction of movement thereof but in opposite directions to each other. The four cable means or ropes are each fixed to one of the ends of the second and third threaded shafts of the second and third screw means for hanging the suspender from the crane.

In accordance with further advantageous features of the present invention, second and third nut means threaded in the same direction as those of the second and third threaded shafts are respectively threadably mounted on the second and third threaded shafts, with gears being mounted on each of the second and third nut means and meshing with each other. Moreover, means are provided for rotatably driving one of the second and third nut means.

Advantageously, in accordance with the present invention, the first screw means has two first threaded shafts arranged parallel to each other, with the second and third threaded shafts being arranged parallel to each other between the first two threaded shafts in a plane defined by the two first threaded shafts.

The four cable means or ropes are, in accordance with the present invention, arranged so as to suspend the suspender at four points such that two cable means or ropes positioned diagonally at two of the four points are attached to either end of the first threaded shaft, and the remaining two cable means or ropes are attached to either end of the second threaded shaft.

It is also possible in accordance with the present invention, for the four cable means or ropes to be arranged so as to suspend the suspender at four positions such that the two cable means or ropes suspending the two points on one side are attached to either end of the second threaded shaft and the remaining two ropes or cable means suspending the other side are attached to either end of the third threaded shaft.

Accordingly, it is an object of the present invention to provide a control apparatus for simultaneously controlling two orientations of a suspender hung from an overhead crane which avoids, by simple means, shortcomings and disadvantages encountered in the prior art.

Another object of the present invention resides in providing a control apparatus which simultaneously controls two orientations of a suspender hung from an overhead crane which is readily adapted to maintain an oriented state of the suspender during operation of the crane.

A still further object of the present invention resides in providing a control apparatus for simultaneously controlling two orientations of a suspender hung from an overhead crane by four cable means or ropes which functions realiably under all operating conditions of the crane.

A still further object of the present invention resides in providing a control apparatus for simultaneously controlling two orientations of a suspender hung from an overhead crane which is simple in construction and therefore relatively inexpensive to manufacture.

These and other objects, features, and advantages of the present invention will become more apparent from the following description when taken in connection with the accompanying drawings which show, for the purpose of illustration only, one embodiment in accordance with the present invention, and wherein:

DESCRIPTION OF THE PREFERRED EMBODIMENT

Figure 2:
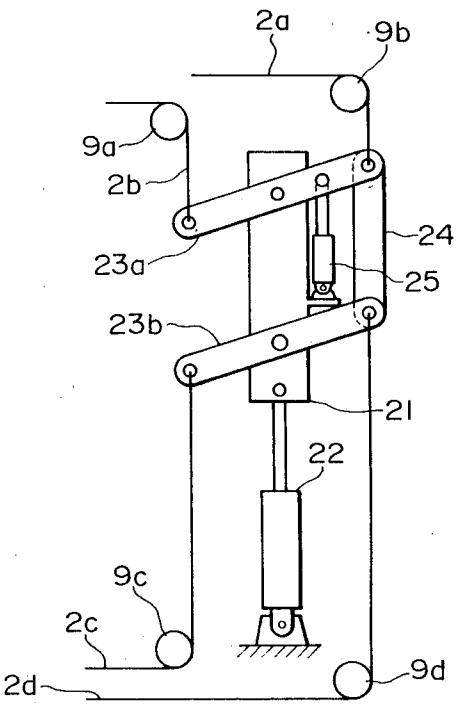
FIG. 2 PRIOR ART
FIG. 2 is a top plan view of the orientation controlling apparatus of FIG. 1.
Figure 1:
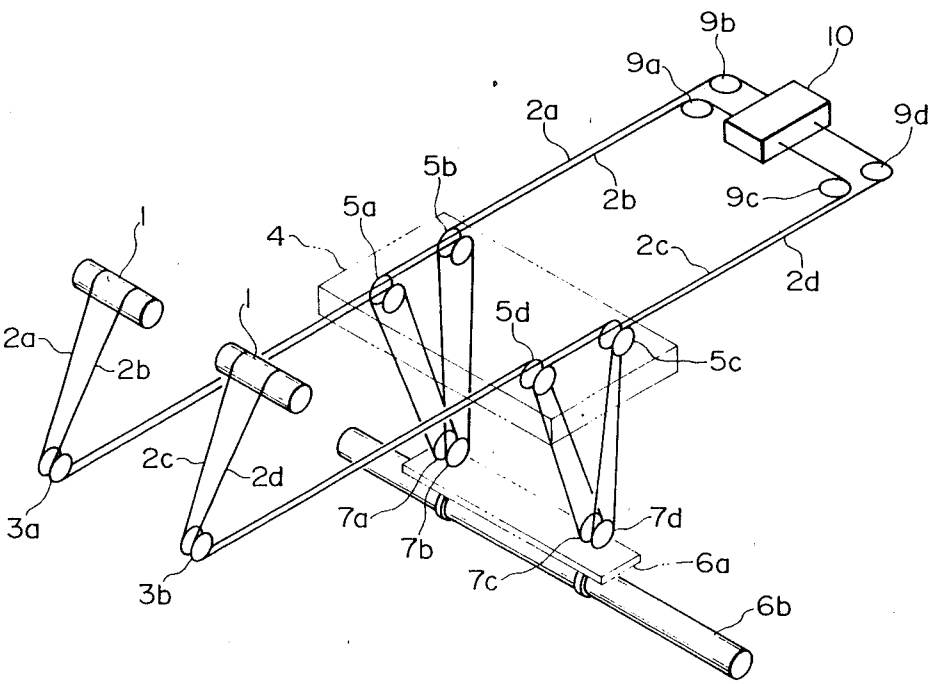
FIG. 1 PRIOR ART
FIG. 1 is a schematic perspective view illustrating paths of ropes of a crane suspender orientation controlling apparatus in accordance with the prior art.

Referring now to the drawings wherein like reference numerals are used throughout the various views to designate like parts and, more particularly, to FIGS. 1 and 2, according to these figures, an orientation controlling apparatus of the type disclosed, for example, in aforementioned Japanese Publication No. 24786/1982, includes a plurality of ropes 2*a*, 2*b*, 2*c* and 2*d* extending from a winch 1 around sheaves 3*a*, 3*b* rotatable mounted on a girder (not shown), around one side of sheaves 5*a*, 5*b*, 5*c*, and 5*d* mounted on a trolley 4, around sheaves 7*a*, 7*b*, 7*c*, 7*d* on a suspender 6*a*, around the other sides of sheaves 5*a*, 5*b*, 5*c*, 5*d*, and around sheaves 9*a*, 9*b*, 9*c* and 9*d*, at the other end of the girder with the ropes then being fixed to an orientation control apparatus 10.

As shown in FIG. 2, the orientation control apparatus 10 includes a lever block 21 reciprocably mounted on the girder, a longitudinal inclination cylinder 22 for reciprocating the lever block 21, levers 23*a* and 23*b* pivotally connected to the lever block 21, a link 24 connecting the two levers 23*a*, 23*b*, and a slewing cylinder 25 having one end fixed to the lever block 21 and the other end to the lever 23*a*. The ropes 2*a*, 2*b*, 2*c* and 2*d* are fixed, in a conventional manner, to appropriate ends of the levers 23*a*, 23*b*.

With the construction of FIGS. 1 and 2, if, for example, the longitudinal inclination cylinder 22 is contracted, the lever block 21 is moved to pull on the ropes 2*a*, 2*b* and slacken the ropes 2*c*, 2*d* so that the right hand side of the suspender 6*a* is lowered to effect a longitudinal inclination. If, for example, the slewing cylinder 25 is extended, the levers 23*a* and 23*b* are displaced so as to pull on the ropes 2*b*, 2*d* and slacken the ropes 2*a*, 2*c*, so that the suspender 6*a* is slewed.

After the suspender 6*a* has been rotated from the normal orientation position caused by the load to the controlled orientation position, a reaction restoring the normal rope tensions is exerted on the cylinders 22, 25. However, in order to maintain the controlled orientation position, it is necessary to provide means such as, for example, brakes for fixing the piston rods of the cylinders 22, 25 thereby resulting in providing a construction which is relatively complicated.

Figure 3:
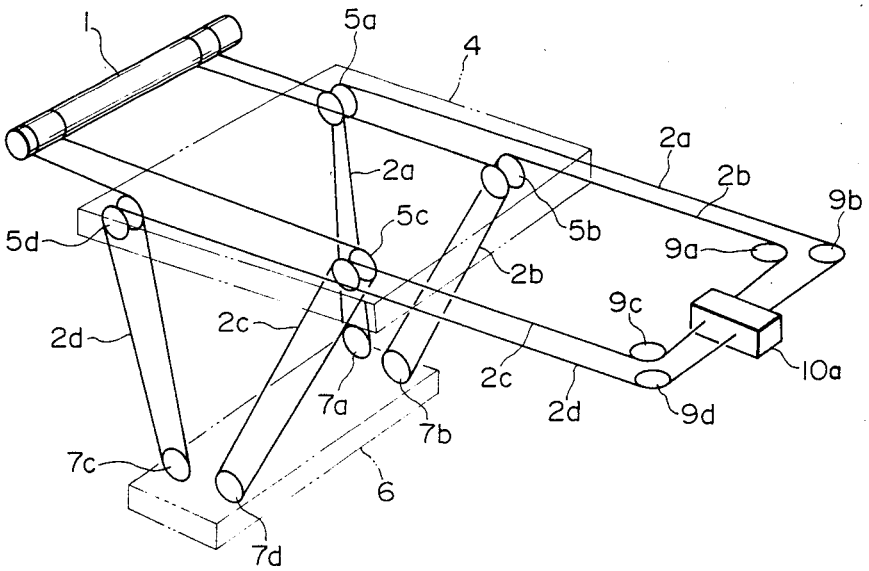
FIG. 3 PRIOR ART
FIG. 3 is a schematic perspective view of paths of ropes of another crane suspender orientation controlling apparatus in accordance with the prior art.
Figure 4:
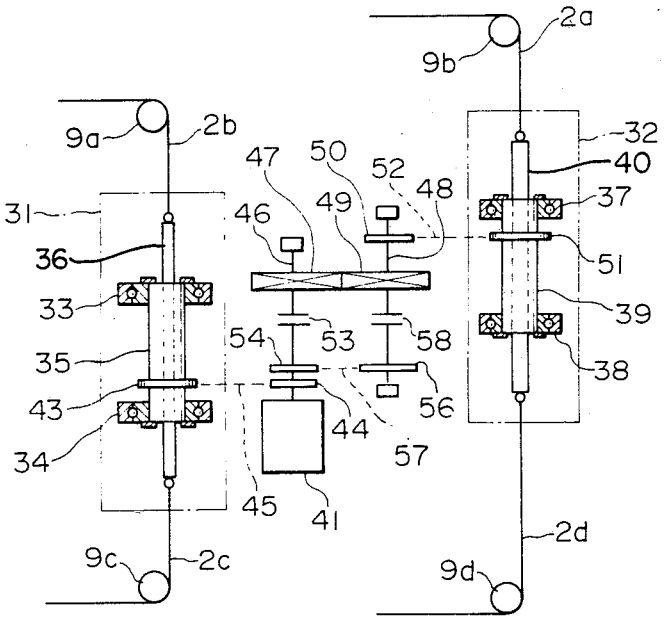
FIG. 4 PRIOR ART
FIG. 4 is a top plan view of the orientation controlling apparatus of FIG. 3.

As shown in FIGS. 3 and 4, a prior art system of the type disclosed for example, in aforementioned Japanese Publication No. 81086/1982, includes a plurality of sheaves 7*a*, 7*b*, 7*c*, 7*d* rotatably mounted on the suspender 6 at four points, with ropes 2*a*, 2*b*, 2*c*, 2*d* extending around the corresponding sheaves in the manner described hereinabove in connection with FIGS. 1 and 2.

An orientation controlling apparatus 10*a* includes, as shown most clearly in FIG. 4, two roped-tensioning mechanisms 31, 32 with a drive means 41 being provided for driving the rope tensioning mechanism 31, 32. The rope tensioning mechanisms 31, 32 respectively include bearings 33, 34, and 37, 38 fixed to a girder, with nuts 35, 39 being supported between the respective sets of bearings. Nuts 35, 39 are threadably mounted on threaded shafts 36, 40, with sprocket wheels 43, 51 being fixed to the nuts 35, 39. When the nuts 35, 39 are rotated, the threaded shafts 36, 40 move axially in order to operate the ropes 2*a*, 2*b*, 2*c*, 2*d*.

If the drive motor 41 is energized with a clutch 53 in a release or disengaged position but with a clutch 58 being in an engaged or applied position, the nut 35 is rotated by a sprocket wheel 44 and a chain 45, with the nut 39 being rotated by a sprocket wheel 54, a chain 57, a sprocket wheet 56, a sprocket wheel 50, and a chain 52. As a result of the driving action of the drive motor 41, the nuts 35 and 39 are rotated in the same direction so that the threaded shafts 36, 40 move in the same direction.

As a result of the rotation of the threaded shafts 36, 40, for example, the ropes 2*c* and 2*d* are tightened, whereas, the ropes 2*a* and 2*b* are slackened so that the suspender 6 is longitudinally inclined. On the other hand, if the motor 41 is energized with the clutch 58 released or disengaged and the clutch 53 engaged or applied, a shaft 48 is rotated in a direction opposite to that of the shaft 46 since the shafts 46 and 48 are connected by gears 47, 49. Consequently, the threaded shaft moves in a direction opposite to that of the threaded shaft 36 so that, for example, the ropes 2*a*, 2*c* are tightened whereas the ropes 2*d*, 2*b* are slackened so that the suspender 6 is rotated.

By virtue of the above-described arrangement, a reaction due to the orientation control is exerted on the shafts 36, 40 and is bore by a self-locking action of the screw threads acting between the nuts 35 and 39 and the threaded shafts 36, 40, so that no special measures need be taken for maintaining a special orientation position of the spreader 6.

Figure 5:
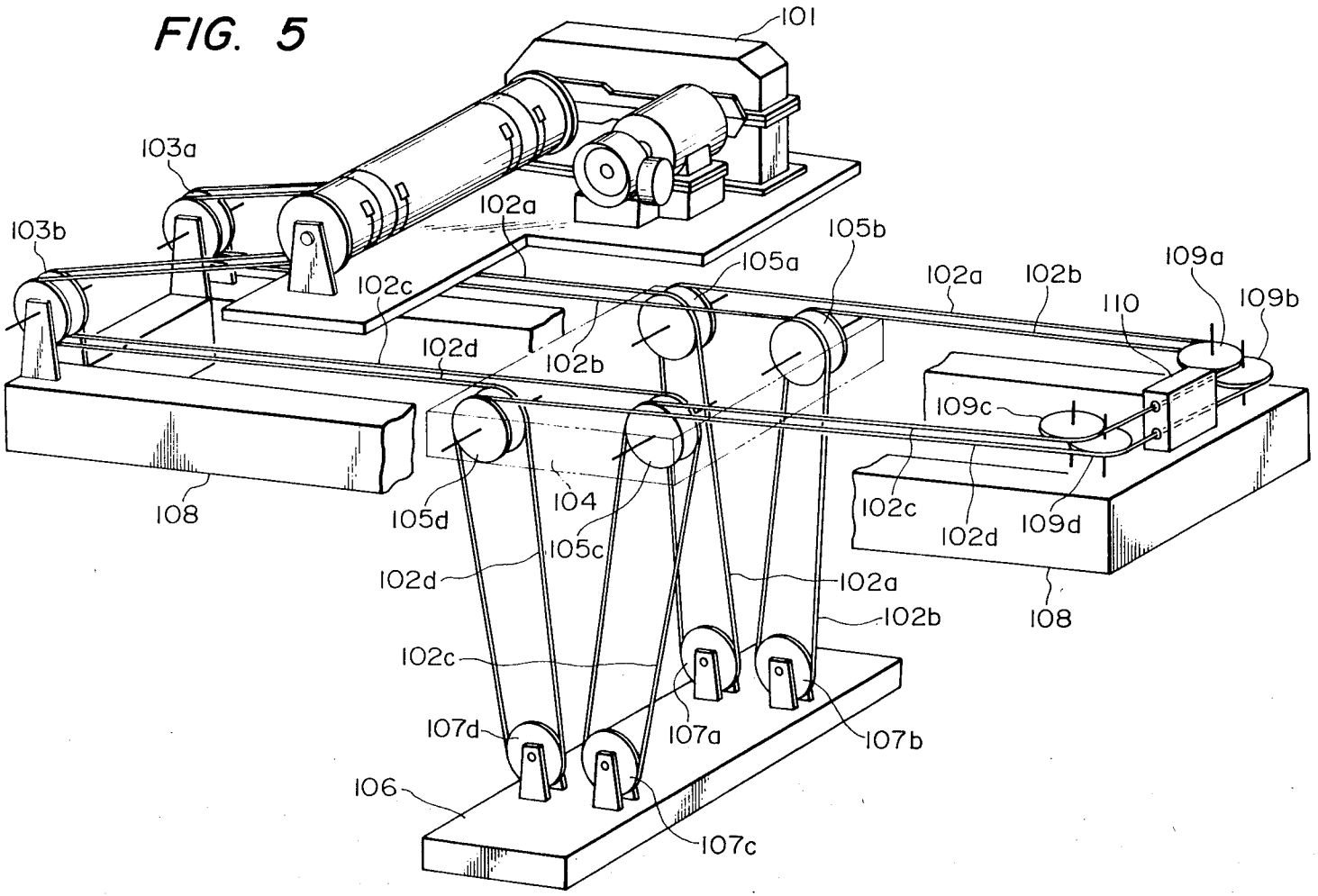
FIG. 5 is a perspective view of paths of the rope or cable of a crane suspender orientation controlling apparatus in accordance with the present invention.
Figure 6:
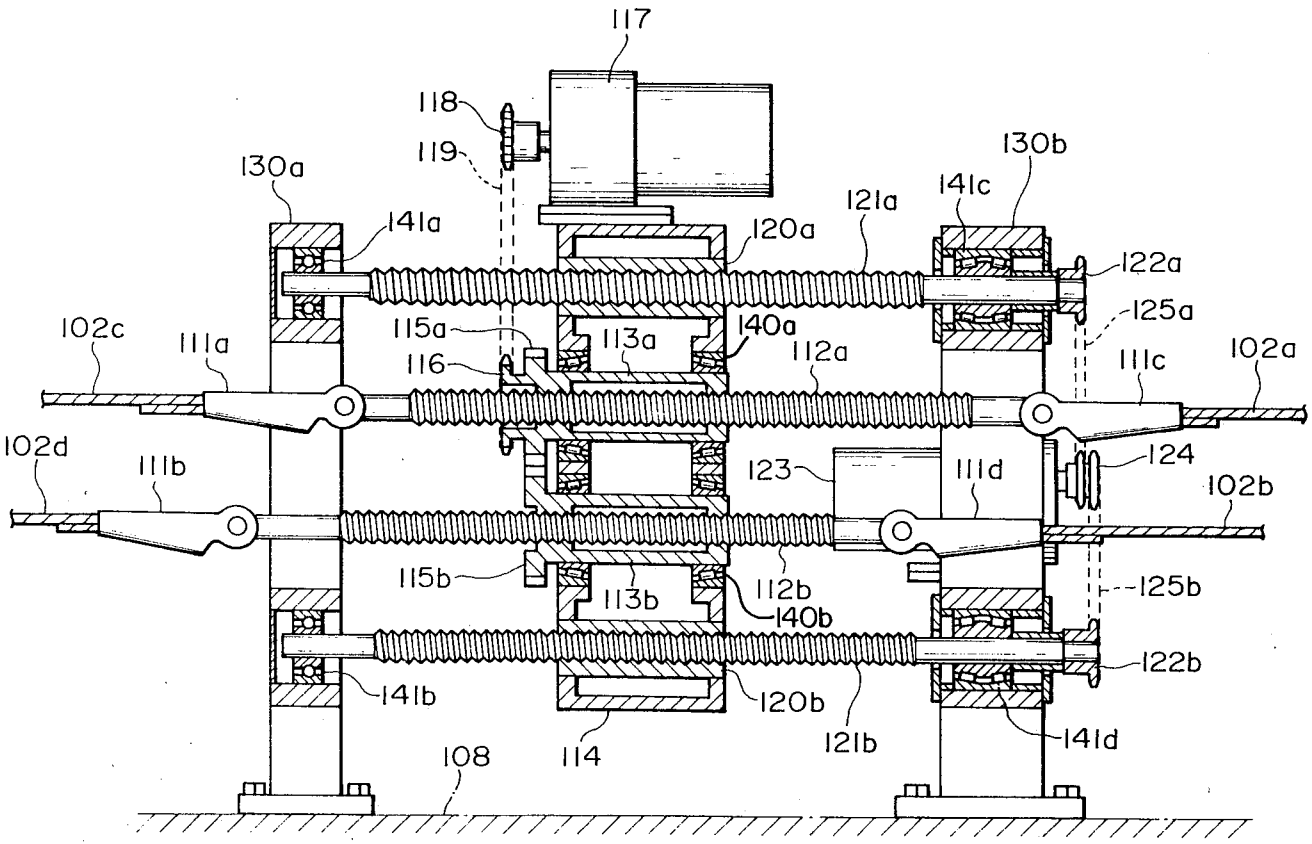
FIG. 6 is a longitudinal cross sectional view of the orientation controlling apparatus of FIG. 5.

In accordance with the present invention, as shown in FIGS. 5 and 6, a trolley 104 is arranged on a girder 108 of an overhead crane so that the trolley 104 can run freely, with a winch 101 being attached to the girder 108. Sheaves 103*a*, 103*b* are rotatably mounted at one end of the girder 108, with sheaves 109*a*, 109*b*, 109*c*, 109*d* being arranged at the other end of the girder 108 along with an orientation controlling apparatus 110. Four cable means or ropes 102*a*, 102*b*, 102*c*, 102*d*, paid out of the winch 101, run around the sheaves 103*a*, 103*b*, mounted on the girder 108, sheaves 105*a*, 105*b*, 105*c*, 105*d* carried on the trolley 104, sheaves 107*a*, 107*b*, 107*c*, 107*d* mounted on a suspender 106 for a container, around the other sides of the sheaves 105*a*, 105*b*, 105*c*, 105*d*, and then around equalizer sheaves 109*a*, 109*b*, 109*c*, 109*d*, with the respective ends of the cable means or ropes 102*a*, 102*b*, 102*c*, 102*d* being fixed to the orientation controlling apparatus 110.

Each of the sheaves 103*a*, 103*b*, and sheaves 105*a*, 105*b*, 105*c*, 105*d*, are constructed of a pair of coaxially arranged rotatably mounted sheaves, with the ropes 102*c*, 102*d* running around the forward sheaves 103*b* and respectively passing around the sheaves 105*c*, 105*d* at the forward end of the trolley 104, the sheaves 107*c*, 107*d* on the forward end of the suspender 106, around the other of the pair of sheaves 105*c*, 105*d*, the equalizer sheaves 109*c*, 109*d*, and are connected to the orientation controlling apparatus 110. The ropes 102*a*, 102*b*, disposed around the sheaves 103*a* respectively run, on a farther side, around the sheaves 105*a*, 105*b*, 107*a*, 107*b*, as well as the sheaves 105*a*, 105*b*, and the equalizer sheaves 109*a*, 109*b*, and are connected to the orientation controlling apparatus 110. The means of attaching the sheaves 105*a*, 105*b*, 105*c*, 105*d*, as well as the means for running or driving the trolley 104 are conventional and well known in the art; therefore, a further description thereof is considered unnecessary.

As shown most clearly in FIG. 6, the ropes 102*a*, 102*b* are fixed to either end of a threaded shaft 112*a* by rope sockets 111*a*, 111*c*, respectively, with the ropes 102*b*, 102*d* being fixed to either end of a threaded shaft 112*b* by means of rope sockets 111*b*, 111*d*, respectively. The threaded shafts 112*a*, 112*b*, are arranged parallel to each other and nuts 113*a*, 113*b* are threadably attached onto the threaded shafts 112*a*, 112*b*, respectively, with the nuts 113*a*, 113*b*, being rotatably mounted on a movable frame 114 by bearings 140*a*, 140*b*, respectivley. The nuts 113*a*, 113*b* are immovable in an axial direction with respect to the movable frame 114. A portion of the nuts 113*a*, 113*b* are provided with gears 115*a*, 115*b* which are adapted to mesh with each other, with a sprocket wheel 116 being fixedly secured to a portion of the nut 113*a*. The sprocket wheel 116 is connected by a chain 119 to a sprocket wheel 118 of a gear motor 117 which is mounted at a center of the top of the movable frame 114. The threades of the threaded shafts 112*a*, 112*b* have the same direction and pitch as each other, and the threaded shafts 112*a*, 112*b* are arranged one above the other. Thus, the two screw mechanisms for moving the threaded shafts 112*a*, 112*b*, are mounted on the movable frame 114.

Axially fixed non-rotatably mounted nuts 120*a*, 120*b* are respectively disposed at the upper and lower portions of the movable frame 114, with the nuts 120*a*, 120*b* being adapted to threadably accommodate threaded shafts 121*a*, 121*b* arranged in parallel to and respectively disposed above and below the threaded shafts 112*a*, 112*b*. All of the threaded shafts 112*a*, 112*b*, 112*c*, 112*d* are arranged on one common plane, with the respective ends of each of the threaded shafts 121*a*, 121*d* being rotatably supported on stationary frames 130*a*, 130*b*, by bearings 141*a*, 141*b* and 141*c*, 141*d*. The stationary frames 130*a*, 130*b* are formed with openings through which the threaded shafts 112*a*, 112*b* as well as the sockets 111*a*, 111*b*, 111*c*, and 111*d* extend. For this purpose, each of the stationary frames 130*a*, 130*b* is provided with a pair of spaced posts aligned in a plane perpendicular to the plane of the drawing and the bearings 141*a*, 141*b*, 141*c*, 141*d*, etc., are arranged between the posts. The stationary frames 130*a*, 130*b* are fixed onto the girder 108.

The threaded shafts 121*a*, 121*b* are respectively provided at one end thereof with sprocket wheels 122*a*, 122*b* connected, through chains 125*a*; 125*b*, to a sprocket wheel 124 of a gear motor 123. The gear motor 123 is attached to a side of the stationary frame 130, and the threads of the threaded shafts 121*a*, 121*b* have the same direction pitch. The threaded shafts 121*a*, 121*b*, nuts 120*a*, 120*b*, etc., form a first screw mechanism for moving the movable frame 114.

With the above described construction, a lateral inclination is performed if the gear motor 117 is energized; whereas, a longtiduinal inclination is performed if the gear motor 123 is energized. More particularly, when the gear motor 123 is energized, the threaded shafts 121*a*, 121*b*, are turned by the sprocket wheel 124, the chains 125*a*, 125*b*, and the sprocket wheels 122*a*, 122*b*, so that the nuts 120*a*, 120*b* engaged therewith move through the same distance in an axial direction. As a result of the energization of the gear motor 123, the movable frame 114 moves in an axial direction so that the cable means or ropes 102*a*, 102*b*, 102*c*, 102*d* are moved.

Assuming that the threaded shafts 121*a*, 121*b*, have right handed threads, if the gear motor 123 operates in a clockwise direction, the threaded shafts 121*a*, 121*b* also turn in a clockwise direction so that the movable frame 114 moves to the right of FIG. 6 and, as a result of this movement the threaded shafts 112*a*, 112*b* also move to the right, whereby the cable means or ropes 102*a*, 102*b* suspending one lateral side of the suspender 106 are slackened from the orientation controlling apparatus 110, whereas, the ropes 102*c*, 102*d* suspending the other side of the suspender 106 are tightened. Consequently, the first side of the suspender 106 is raised while the other side is lowered so that a longitudinal inclination is performed. On the other hand, when the gear motor 123 is turned or operated in a clockwise direction, the threaded shafts 112*a*, 112*b* move to the left of FIG. 6 so that a longitudinal inclination is performed to lower the above noted first side of the suspender 106.

When the gear motor 117 is energized, the sprocket wheel 116 is turned by the sprocket wheel 118 and the chain 119 so that the nut 113*a* and the gear 115*a* are turned together therewith; however, the nut 113*b* is turned in a direction opposite to that of the nut 113*a* by the gear 115*b* meshing with the gear 115*a* and, consequently, the threaded shafts 112*a* 112*b*, threadably engaged with the respective nuts 113*a*, 113*b*, move in opposite directions.

Assuming the threaded shafts 112*a*, 112*b* have right handed threads, the nut 113*a* turns clockwise but the nut 113*b* turns counterclockwise when the gear motor 117 operates in a clockwise direction and, consequently, the threaded shaft 112*a* moves to the right of FIG. 6; whereas, the threaded shaft 112*b* moves to the left so that the cable means or ropes 102*a* 102*d* suspending one longitudinal side of the suspender 106 are slackened from the orientation controlling apparatus 110, while the ropes 102*b* and 102*c* suspending the other side of the suspender 106 are tightened. Consequently, the first side of the suspender 106 is raised; whereas, the other side is lowered so that a lateral inclination is performed. If the gear motor 117 operates in a counterclockwise direction, the threaded shaft 112*a* moves to the left; whereas, the threaded shaft 112*b* moves to the right, so that a lateral inclination is performed to raise the other side and lower the first side of the suspender 106.

Since the two threaded shafts 112*a*, 112*b*, mounted on the movable frame 114, can move in opposite directions to each other, and since the frame 114 itself is movable, a simultaneous longitudinal inclination as well as a lateral inclination can readily be carried out or alternatively, one inclination can be conducted before the other. In other words, two orientation controls can be simultaneously effected with each other.

Since the combinations of threaded shafts and nuts are used for each of the two orientation control means, the reactions subsequent to the orientation control may be borne by self-locking actions of the threaded shafts and nuts, which self-locking actions are sufficient to stop the gear motors 117, 123. Thus, any other necessary construction or equipment for bearing the reactions may be dispensed with so that a compact inexpensive apparatus can readily be manufactured. As can readily be appreciated, the pitch and shape of the screw threads are determined so as to ensure the self-locking of the necessary reactions of the suspender 106 after the carrying out of an orientation control. Moreover, it is assumed in the above description that there is no rotation of the threaded shafts 112*a*, 112*b* due to rotation of the ropes 102*a*, 102*b*, 102*c*, 102*d*.

As a result of second and third screw mechanisms mounted on the movable frame which can be moved by the first screw mechanism composed of the threaded shafts 121*a*, 121*b*, nuts 120*a*, 120*b*, gear motor 123, etc., and the ropes suspending from the suspender 106 being fixed to threaded shafts of the second and third screw mechanisms, the dimensions of the orientation controlling apparatus 110 can be made relatively small. Furthermore, if the gear motor 123 is arranged at the top of the stationary frame 130*b*, the lateral dimensions of the orientation controlling apparatus 110 can also be reduced.

While the construction of FIGS. 5 and 6 described hereinabove provides for two threaded shafts 121*a*, 121*b* in order to move the movable frame 114, it is also possible in accordance with the present invention to provide one threaded shaft for moving the frame 114 with another shaft member being provided for preventing any rotation of the movable frame 114. For this purpose, the other shaft member may, for example, take the form of a sliding shaft.

When a lateral inclination is to be carried out, the threaded shafts 112*a*, 112*b* move in opposite directions so that a force couple is generated in the supporting parts of the threaded shafts 112*a*, 112*b* by the movable frame 114. However, since the threaded shafts 121*a*, 121*b* are arranged in a common single plane defined by the threaded shafts 112*a*, 112*b* on either side of the threaded shafts 112*a*, 112*b*, the orientation controlling apparatus 110 readily provides a dynamically reasonable construction to cope with the force couple. More specifically, the force couple is replaced by axial forces along the threaded shafts 121*a*, 121*b* so that no excess moment is generated thereby making it possible to increase the strength realiability of the threaded shafts 121*a*, 121*b*. Moreover, since the threaded shafts 112*a*, 112*b* are positioned within or between the threaded shafts 121*a*, 121*b*, the shafts 112*a*, 112*b* can easily turn in opposite directions by way of very simplified construction.

Figure 7:
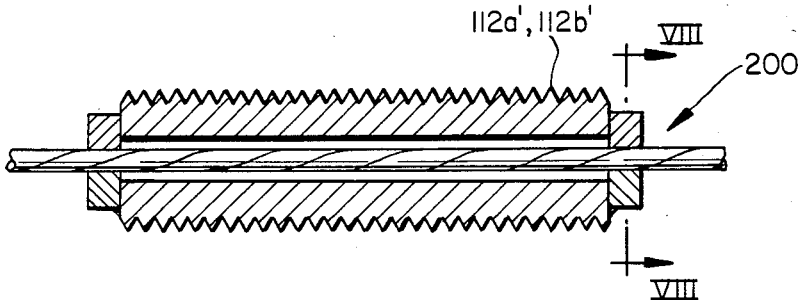
FIG. 7 is a side view of a hollow shaft arrangement for an orientation controlling apparatus constructed in accordance with the present invention.
Figure 8:
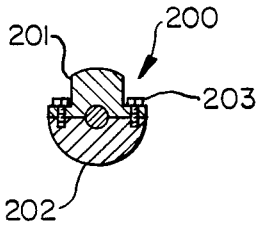
FIG. 8 is a cross-sectional view taken along the line VIII—VIII of FIG. 7 of a cable or rope gripping device.

When the shaft 112*a* is provided with a thread opposite to the thread of the shaft 112*b*, the nuts 115*a*, 115*b* are threaded so as to turn in the same direction. If the threaded shafts 112*a*, 112*b* are hollow, as shown in FIGS. 7 and 8, the ropes or cable extend through the hollow threaded shafts 112*a*, 112*b*, with a cable or rope grip means generally designated by the reference numeral 200 being disposed at respective ends of the threaded shafts for securing the respective ropes or cable with respect to the threaded shafts. By virtue of this arrangement, the reaving of the ropes or cables is facilitated since the ropes or cables will be disposed substantially straight between the equalizing sheaves. Moreover, it is possible to safely suspend the load because, even though the rope grip means 200 may have some slippage, the load will stop at a specific level by a tightening of the cable or rope means. As shown in FIG. 8, the cable or rope grip means 200 includes a base or bottom member 202 adapted to accommodate the rope or cable and a clamping member 201 adapted to be secured to the base member 202 by suitable fastening means such as, for example, threaded fasteners 203 or the like, whereby the rope or cable is gripped between the clamping member 201 and the base member 202.

To, for example, slew the suspender 106, the distances between the sheaves 105*a*, 105*b* and the sheaves 105*d* 105*c* or the trolley 104 can be made larger than the corresponding distances between the sheaves 107*a*, 107*b* and 107*c*, 107*d* of the suspender 106, with the ropes 102*a*, 102*d* being fixed to either end of the threaded shaft 112*a*, and the ropes 102*b*, 102*c* being fixed to either end of the threaded shaft 112*b*. A slewing motion can be conducted by the gear motor 117, and a longitudinal inclination can be conducted by the energization of the gear motor 123.

The suspender 106 may, in a conventional manner, be used to suspend a relatively long article and, with such an arrangement, the two sheaves at the ends of the suspender 106 are arranged coaxially as is conventional.

The cable means or ropes 102*a*, 102*b*, extending around the sheaves 107*a* 107*b* positioned laterally across the suspender 106, can be fixed to either end of the threaded shaft 112*a*. The cable means or rope on one side is fixed to the threaded shaft through the sheave on the other side, with the cable means or ropes 102*c*, 102*d* on the other side being fixed similarly to the threaded shaft 102*b*. Consequently, a slewing motion and lateral inclination can readily be carried out.

In a conventional method of tensioning the cable means or ropes between the trolley 104 and suspender 106, the cable means or ropes are extended so as to cross, as viewed laterally of the suspender 106, and, in such an arrangement, the present invention is also applicable. For example, the cable means or rope 102*a* may extend around the equalizer sheave 109*a* through the sheaves 105*a*, 107*a* and 105*a*, with the cable means or rope 102*b* extending around the equalizer sheave 109*b* through the sheaves 105*a*, 107*b*, 105*b*. The cable means or rope 102*c* may extend around the equalizer sheave 109*c* through the sheaves 105*d*, 107*c*, 105*c* with the cable means or rope 102*d* extending around the equalizer 109*d* through the sheaves 105*d*, 107*d*, 105*c*. The cable means or ropes 102*a*, 102*d* may be attached to the threaded shaft 112*a*, with the cable means or ropes 102*b*, 102*c* being attached to the threaded shaft 112*b*. In this arrangement, a longitudinal inclination is effected by operating the gear motor 123, and a slewing motion is effected by operating the gear motor 117. On the other hand, if the cable means or ropes 102*a*, 102*c* are attached to the threaded shaft 112*a*, with the ropes or cable means 102*b*, 102*d* being attached to the threaded shaft 112*b*, longitudinal and lateral inclinations can be effected.

As apparent from the above description, a variety of orientations can be controlled by different manners of running the cable means or ropes between the trolley 104 and suspender 110. In other words, any desired orientation control can be attained depending upon the manner in which the four cable means or ropes suspending the suspender 106 are connected to each of the ends of the threaded shafts 112*a*, 112*b*.

While I have shown and described only one embodiment in accordance with the present invention, it is understood that the same is not limited thereto but is susceptible of numerous changes and modifications as known to one having ordinary skill in the art and I therefore do not wish to be limited to the details shown and described herein, but intend to cover all such modifications as are encompassed by the scope of the appended claims.

I claim:

1. An apparatus for controlling an orientation of a suspender means of an overhead crane, the apparatus comprising: at least four cable means for supporting said suspender means from the overhead crame, a frame means, means for selectively moving said frame means so as to enable an adjustment of the cable means, a first threaded means mounted on said frame means for movement relative to said frame means in a first direction, a second threaded means mounted on said frame means for movement relative to said frame means in a direction opposite to said first direction, said first and second threaded means being arranged substantially in parallel to a direction of movement of said frame means, and wherein an end of two of said cable means is attached to said first threaded means and an end of the other two cable means is attached to said second threaded means.

2. An apparatus according to claim 1, further comprising first and second nut means rotatably mounted in said frame means and respectively threadably engaged with said first and second threaded means, said nut means being threaded in the same direction as said first and second threaded means, gear means mounted on each of said nut means, said gear means being in meshing engagement with each other, and wherein said means for moving said frame means includes drive means operatively connected with one of said nut means for rotatably driving the same.

3. An apparatus according to claim 2, wherein said means for moving the frame means further includes first and second threaded shafts arranged in parallel to each other and to said first and second threaded means, said first and second threaded means being disposed between and in a common plane with said first and second threaded shafts.

4. An apparatus according to claim 3, wherein said four cable means are arranged at four points of said suspender means such that two diagonally opposite cable means are respectively attached to opposite ends of said first threaded means and the other two cable means are respectively attached to opposite ends of said second threaded means.

5. An apparatus according to claim 3, wherein said four cable means are arranged at four points of said suspender means such that two cable means disposed on a same side of the suspender means are respectively attached to opposite ends of said first threaded means and the other two cable means are respectively attached to opposide ends of said second threaded means.

6. An apparatus according to claim 1, wherein said means for moving the frame means further includes first and second threaded shafts arranged in parallel to each other and to said first and second threaded means, said first and second threaded means being disposed between and in a common plane with said first and second threaded shafts.

7. An apparatus according to claim 1, wherein said four cable means are arranged at four points of said suspender means such that two diagonally opposite cable means are respectively attached to opposite ends of said first threaded means and the other two cable means are respectively attached to opposite ends of said second threaded means.

8. An apparatus according to claim 1, wherein said four cable means are arranged at four points of said suspender means such that two cable means disposed on a same side of the suspender means are respectively attached to opposite ends of said first threaded means and the other two cable means are respectively attached to opposite ends of said second threaded means.

9. An apparatus according to claim 1, wherein said means for moving said frame means includes a threaded shaft means and a guide means arranged in parallel to each other and to said first and second threaded means, said first and second threaded means being disposed between and in an common plane with said threaded shaft means and said guide means.

10. An apparatus according to claim 1, wherein said means for moving said frame means includes a pair of threaded shaft means disposed in parallel to said first and second threaded means, and drive means operatively connected to said pair of threaded shaft means for rotatably driving said shaft means.

11. An apparatus according to claim 10, further comprising first and second nut means rotatably mounted in said frame means and respectively threadably engaged with said first and second threaded means, said nut means being threaded in the same direction as said first and second threaded means, gear means mounted on each of said nut means, said gear means being in meshing engagement with each other, and means operatively connected with one of said nut means for rotatably driving one of said nut means.

* * * * *